United States Patent [19]

Suzuki et al.

[11] Patent Number: 4,575,711

[45] Date of Patent: Mar. 11, 1986

[54] ALARM TERMINAL DEVICE

[75] Inventors: Takashi Suzuki; Tetsuo Kimura, both of Tokyo; Seiichi Tanaka, Chiba, all of Japan

[73] Assignee: Nittan Company, Limited, Tokyo, Japan

[21] Appl. No.: 535,142

[22] Filed: Sep. 23, 1983

[30] Foreign Application Priority Data

Sep. 24, 1982 [JP] Japan ..... 57-164966

[51] Int. Cl.[4] ..... G08B 19/00; G08B 29/00

[52] U.S. Cl. ..... 340/521; 340/510; 340/511; 340/506; 340/661

[58] Field of Search ..... 340/521, 522, 500, 506, 340/507, 508, 509, 510, 511, 526, 588, 589, 628, 632, 633, 634, 635, 653, 657, 658, 660–664

[56] References Cited

U.S. PATENT DOCUMENTS 4,282,517 8/1981 Wilson, Jr. et al. ..... 340/511
4,352,087 9/1982 Wittmaier ..... 340/632
4,394,655 7/1983 Wynne et al. ..... 340/511
4,414,539 11/1983 Armer ..... 340/511

*Primary Examiner*—Donnie L. Crosland
*Attorney, Agent, or Firm*—Hill, Van Santen, Steadman & Simpson

[57] ABSTRACT

An alarm terminal device has a lower limit voltage generator for generating as a lower limit voltage an analog signal which is produced from a temperature sensor and which is lower than a first predetermined value, and an upper limit voltage generator for generating as an upper limit voltage an analog signal which is produced from the temperature sensor and which is higher than a second predetermined value. At least one additional sensor is provided for generating an analog data signal having a voltage higher than the upper limit voltage or lower than the lower limit voltage so as to indicate any information other than that contained in the analog signal from the temperature sensor. A disconnection or a short circuit of a platinum resistor of the temperature sensor can thus be represented by the analog data signal to be quantized by an analog-to-digital converter employed in the sensor.

18 Claims, 2 Drawing Figures

ALARM TERMINAL DEVICE

BACKGROUND OF THE INVENTION

The present invention relates to an alarm terminal device such as a fire alarm terminal device or the like. More particularly, the present invention relates to an alarm terminal device for converting to a digital signal an analog signal indicating a smoke concentration, a gas concentration, a temperature, or other parameter.

It is known to arrange an alarm terminal device such as a fire alarm terminal device such that a detected signal (analog signal) from a temperature sensor or the like is converted to a digital signal which is received by a receiver. Therefore, information other than the detected signal indicating a temperature or the like cannot be obtained. For example, information corresponding to a disconnection or short circuit of a platinum resistor as a major component of a temperature sensor cannot be transmitted through the same transmission line. In order to transmit breakdown data such as data indicating the disconnection or short circuit of the platinum resistor, another transmission line must be provided, or different types of data must be transmitted in accordance with time division multiplexing, resulting in a complex configuration and high cost. Furthermore, according to the conventional alarm terminal device, a sensor output which is less than a predetermined value is transmitted as digital data, e.g., "000", and another sensor output which exceeds the predetermined value is transmitted as digital data, e.g., "111". As a result, a disconnection or short circuit of the platinum resistor cannot be detected upon reception of such data. Since a platinum wire is very thin, the platinum resistor has a tendency to become disconnected or to short-circuit. Therefore, a disconnection or short circuit of the platinum resistor must be constantly monitored.

SUMMARY OF THE INVENTION

The present invention eliminates the conventional drawback described above, and has for its object to provide an alarm terminal device wherein a sensor output and any other data can be separately obtained from output signals from a single analog-to-digital converter.

In order to achieve the above objective, there is provided an alarm terminal device having a first sensor for generating an analog signal indicating one of the parameters smoke concentration, gas concentration or temperature, and an analog-to-digital converter for converting the analog signal to digital data. A discriminator is provided for discriminating the analog signal in accordance with at least one reference value. At least one second sensor is provided for detecting an analog data signal, indicating information other than that presented by the analog signal from the first sensor. The analog data signal from the at least one second sensor is supplied in parallel with the analog signal from the first sensor to the analog-to-digital converter.

DETAILED DESCRIPTION OF THE PREFERRED EMBODIMENT

An alarm terminal device according to a preferred embodiment of the present invention will be described with reference to the accompanying drawings.

Figure 1:
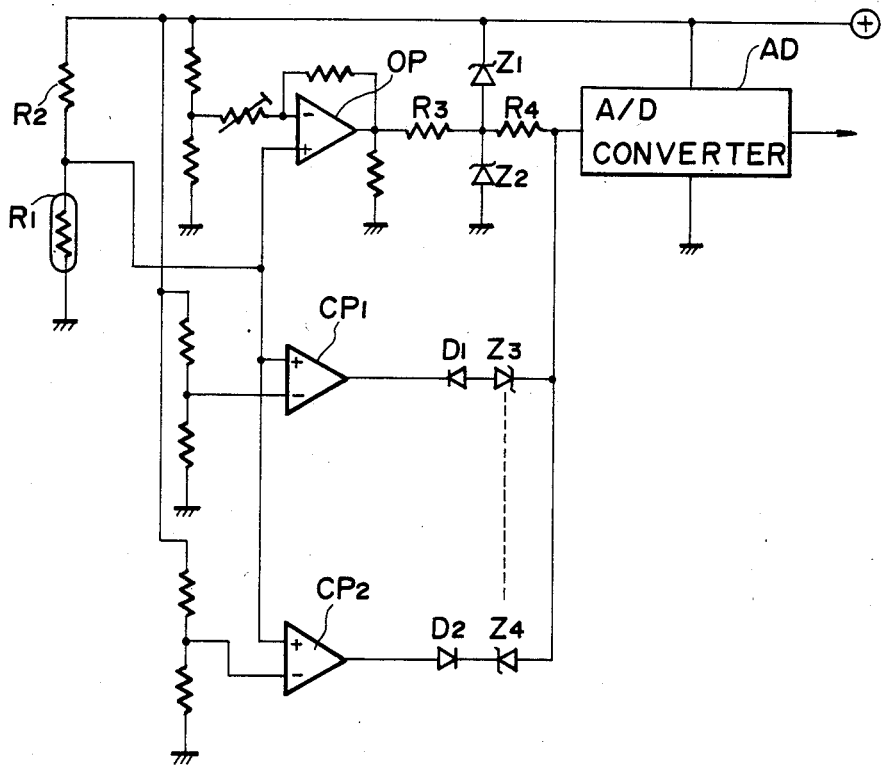
FIG. 1 is a circuit diagram of an alarm terminal device according to a preferred embodiment of the present invention.

FIG. 1 is a circuit diagram of an alarm terminal device to which the present invention is applied. The alarm terminal device serves to convert to a digital signal an analog signal produced from a temperature sensor having a platinum resistor. Referring to FIG. 1, a series circuit of a platinum resistor $R_1$ and a reference resistor $R_2$ is connected between a power supply and ground. A voltage divided by the platinum resistor $R_1$ and the reference resistor $R_2$ is supplied to the noninverting input terminal of an operational amplifier OP. A reference voltage is supplied to the inverting input terminal of the operational amplifier OP. When a resistance of the platinum resistor $R_1$ changes in accordance with a change in temperature, the divided voltage changes. A difference between the divided voltage and the reference voltage is amplified by the operational amplifier OP, so that the operational amplifier OP generates an analog signal corresponding to a temperature detected by the temperature sensor. The analog signal is supplied to an A/D converter AD through resistors $R_3$ and $R_4$. The output terminal of the resistor $R_3$ is connected to the power supply through a Zener diode $Z_1$, and to ground through a Zener diode $Z_2$. In this embodiment, the temperature sensor comprises the platinum resistor $R_1$, the reference resistor $R_2$, the operational amplifier OP, the resistors $R_3$ and $R_4$, and the like. The analog detected signal from the temperature sensor is converted by the A/D converter AD to a digital signal.

When the analog voltage signal from the temperature sensor is less than a predetermined voltage $E_1$, the Zener diode $Z_1$ is turned on, and a current flows in the resistor $R_3$. As a result, the sensor output is set at the predetermined voltage $E_1$. The predetermined voltage $E_1$ is referred to as a lower limit voltage $E_1$. The Zener diode $Z_1$ comprises a lower limit generator.

However, when the analog voltage signal from the temperature sensor exceeds a predetermined voltage $E_2$, the Zener diode $Z_2$ is turned on, so that the sensor output voltage is set at the predetermined voltage $E_2$. The predetermined voltage $E_2$ is referred to as an upper limit voltage $E_2$. The Zener diode $Z_2$ comprises an upper limit generator. An analog voltage of a sensor output which falls within the range between the lower limit voltage $E_1$ and the upper limit voltage $E_2$ is converted by the A/D converter AD to a digital voltage signal without modification.

Figure 2:
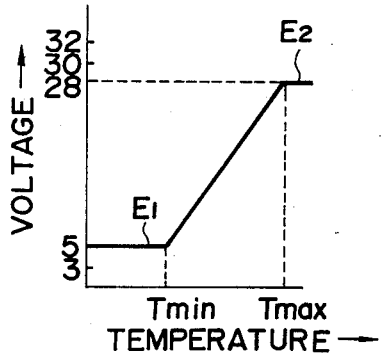
FIG. 2 is a graph for explaining the relation between quantization steps and code assignment thereto in the embodiment shown in FIG. 1.

Now assume that the A/D converter AD comprises a 5-bit converter, and that a potential difference between the power supply voltage and the ground voltage is quantized in accordance with 32 steps as shown in FIG. 2. In this embodiment, voltages between the lower limit voltage $E_1$ and the upper limit voltage $E_2$ are quantized into the range between, e.g., the 5th step and 28th step. For example, the lower limit voltage $E_1$ corresponding to the 5th step is converted to the 5th digital data "00100" (=4 in decimal notation), and the upper limit voltage $E_2$ corresponding to the 28th step is converted to the 28th digital data "11011" (=27 in decimal notation). Voltages corresponding to the steps not exceeding the 4th step ("00011") and not below the 29th step ("11100") are used to transmit any other data excluding the sensor output data. As is apparent from the above description, the reference voltage and the gain of the operational amplifier OP are preset so that the sensor output falls within the range between the lower limit voltage $E_1$ and the upper limit voltage $E_2$ when the detected temperatures fall within a normal temperature range between $T_{min}$ and $T_{max}$.

One end of the platinum resistor $R_1$ is connected to the noninverting input terminals of comparators $CP_1$ and $CP_2$ in parallel therewith. The comparator $CP_1$ serves to detect a short circuit of the platinum resistor $R_1$. The comparator $CP_2$ serves to detect a disconnection of the platinum resistor $R_1$. A voltage slightly higher than the ground potential is applied to the inverting input terminal of the comparator $CP_1$, so that the comparator $CP_1$ normally generates a signal of high level. The output from the comparator $CP_1$ is supplied to the A/D converter AD through a diode $D_1$ and a Zener diode $Z_3$. The diode $D_1$ is reverse-biased by the high level output from the comparator $CP_1$. Therefore, the output from the temperature sensor is normally supplied to the A/D converter AD.

However, when the platinum resistor $R_1$ is short-circuited, the output from the comparator $CP_1$ goes low. A current then flows through the resistor $R_4$, the Zener diode $Z_3$, and the diode $D_1$. As a result, the temperature sensor output (i.e., the input voltage applied to the A/D converter AD) becomes a Zener voltage (forward bias voltage of the diode $D_1$) of the Zener diode $Z_3$. The Zener voltage of the Zener diode $Z_3$ is preset to correspond to the 3rd step of the quantization steps. Therefore, when the platinum resistor $R_1$ is short-circuited, the A/D converter AD generates digital data "00010" (2 in decimal notation). When the receiver receives this digital data, it detects that a short circuit of the platinum resistor has occurred.

A voltage slightly lower than the power supply voltage is supplied to the inverting input terminal of the comparator $CP_2$, so that the comparator $CP_2$ normally generates a signal of low level. The output from the comparator $CP_2$ is coupled in parallel with the sensor output through a series circuit of a diode $D_2$ and a Zener diode $Z_4$. The anode of the diode $D_2$ is connected to the output terminal of the comparator $CP_2$, so that the low level output from the comparator $CP_2$ is blocked by the diode $D_2$.

However, when the platinum resistor $R_1$ is disconnected, the voltage to be applied to the noninverting input terminal of the comparator $CP_2$ is increased to the power supply voltage, and the output from the comparator $CP_2$ goes high. This high level signal is supplied to the A/D converter AD through the diode $D_2$ and the Zener diode $Z_4$. The input voltage applied to the A/D converter AD is lower than the high-level voltage (power supply voltage) from the comparator $CP_2$ by the Zener voltage (forward bias voltage of the diode $D_2$) of the Zener diode $Z_4$. The Zener voltage of the Zener diode $Z_4$ is preset such that the voltage applied to the A/D converter AD corresponds to the 30th step of the quantization steps. In this case, the A/D converter AD generates the digital data "11101" (29 in decimal notation). When the receiver receives this digital data, it detects that the platinum resistor $R_1$ is disconnected. It is possible to transmit any other information by using the digital data "00000" (1st step) to "00011" (4th step) and the digital data "11100" (29th step) to "11111" (32nd step).

In this embodiment, the comparator $CP_1$, the diode $D_1$, and the Zener diode $Z_3$ comprise a second sensor for generating an analog signal of a voltage lower than the lower limit voltage $E_1$ so as to detect a short circuit of the platinum resistor $R_1$. Similarly, the comparator $CP_2$, the diode $D_2$, and the Zener diode $Z_4$ comprise another second sensor for generating an analog signal of a voltage higher than the upper limit voltage $E_2$ so as to detect a disconnection of the platinum resistor $R_1$. In this embodiment, only two second sensors are used. However, three or more second sensors may be used as needed.

According to the embodiment described above, the sensor output analog signal is preset to fall within the upper and lower limit voltages $E_2$ and $E_1$.

Furthermore, one second sensor is arranged to generate a voltage which is lower than the lower limit voltage $E_1$, and the other second sensor is arranged to generate a voltage which is higher than the upper limit voltage $E_2$. The voltage lower than the lower limit voltage $E_1$ is applied to the A/D converter which then produces corresponding digital data indicating a piece of information excluding the sensor output. The voltage higher than the upper limit voltage $E_2$ is applied to the A/D converter which then produces corresponding digital data indicating another piece of information excluding the sensor output. Therefore, erroneous operation and breakdown conditions such as a short circuit and a disconnection can be properly detected. Any desired information can be obtained by using the steps excluding those in the range between the upper and lower limit voltage steps. As a result, the conditions of the terminal device can be properly monitored, thereby improving the reliability of the detected data.

Although various minor changes and modifications might be proposed by those skilled in the art, it will be understood that we wish to include within the claims of the patent warranted hereon all such changes and modifications as reasonably come within our contribution to the art.

We claim as our invention:

1. In an alarm terminal device having a first sensor means for generating an analog signal providing information indicating one of the parameters smoke concentration, gas concentration and temperature, and an analog-to-digital converter means for converting the analog signal to digital data, the improvement comprising:

discriminating means for discriminating the analog signal in accordance with at least one reference value;

at least one second sensor means for generating an analog data signal providing information exclusive of the information in the analog signal from said first sensor means, the analog data signal from said at least one second sensor means being supplied in parallel with the analog signal from said first sensor means to said analog-to-digital converter means; and said discriminating means comprising a limit voltage generator means for generating an upper or lower limit voltage relative to an analog voltage range of the analog signal of the first sensor means.

2. A device according to claim 1 wherein said discriminating means comprises a lower limit voltage generator means for generating a lower limit voltage as said at least one reference value.

3. A device according to claim 1 wherein said discriminating means comprises an upper limit voltage generator means for generating an upper limit voltage as said reference value.

4. A device according to claim 2 wherein said lower limit voltage generator means comprises a Zener diode.

5. A device according to claim 3 wherein said upper limit voltage generator means comprises a Zener diode.

6. A device according to claim 1 wherein said discriminating means comprises a lower limit voltage generator means for generating a lower limit voltage as a first reference value, and an upper limit voltage generator means for generating as an upper limit voltage as a second reference value.

7. A device according to claim 6 wherein said lower and upper limit voltage generator means each comprise a Zener diode.

8. A device according to claim 2 wherein the analog data signal of at least one second sensor means comprises a voltage lower than the lower limit voltage.

9. A device according to claim 8 wherein said at least one second sensor means comprises a comparator, a diode reverse-biased with respect to an output terminal of said comparator, and a Zener diode having an anode connected to an anode of said diode and a cathode connected to said analog-to-digital converter means.

10. A device according to claim 3, wherein the analog data signal of said at least one second sensor means comprises a voltage higher than the upper limit voltage.

11. A device according to claim 10 wherein at least one second sensor means comprises a comparator, a diode forward-biased with respect to an output terminal of said comparator, and a Zener diode having a cathode connected to a cathode of said diode and an anode connected to said analog-to-digital converter means.

12. A device according to claim 6 wherein said at least one second sensor means comprises first and second sensors, said first sensor producing an analog data signal having a voltage lower than the lower limit voltage, and said second sensor producing an analog data signal having a voltage higher than the higher limit voltage.

13. A device according to claim 12 wherein said first sensor comprises a first comparator, a first diode reverse-biased with respect to an output terminal of said first comparator, and a first Zener diode having an anode connected to an anode of said first diode and a cathode connected to said analog-to-digital converter means; and said second sensor comprises a second comparator, a second diode forward-biased with respect to an output terminal of said second comparator, and a second Zener diode having a cathode connected to a cathode of said second diode and an anode connected to said analog-to-digital converter means.

14. An alarm terminal device, comprising:

an environment sensor;

a first sensor means for generating a first analog signal indicative of an alarm parameter of the environment sensor;

a second sensor means for generating an analog data signal providing information to determine whether the environment sensor is correctly functioning to provide the alarm parameter;

the first and second analog data signals being supplied in parallel to a same input of an analog-to-digital converter means; and means for discriminating the first and second analog signals from one another by placing the first analog signal in a first predetermined voltage range and the second analog signal in a second predetermined voltage range outside of the first voltage range.

15. An alarm terminal device according to claim 14 wherein the first sensor means provides information concerning smoke concentration, gas concentration, or temperature and a second sensor means checks functionality of a respective transducer for measuring smoke concentration, gas concentration, or temperature.

16. An alarm terminal device according to claim 14 wherein the first sensor means measures temperature by means of a platinum resistor, and the second sensor means determines whether the platinum resistor is opened; and a third sensor means is provided to determine whether the platinum resistor has shorted.

17. An alarm terminal device according to claim 14 wherein a third sensor means is provided generating a third analog signal for checking the functionality of the first sensor means generating the alarm parameter, the third analog signal lying within a third voltage range outside of said first and second voltage ranges.

18. An alarm terminal device, comprising:

an environment sensor;

a first sensor means for generating a first analog signal indicative of a normal output of the environment sensor when it is functioning correctly;

a second sensor means for generating an analog data signal providing an indication that the environment sensor is defective as an open circuit;

a third sensor means for generating an analog data signal providing information that the environment sensor is defective and shorted;

the first, second, and third analog data signals being supplied in parallel to a same input of an analog-to-digital converter means;

means for discriminating the first, second, and third analog signals from one another by placing the first analog signal in a first predetermined voltage range, the second analog signal in a second predetermined voltage range below or above the first range, and the third analog signal in a third predetermined voltage range above or below the first voltage range; and said discriminating means comprising a lower limit voltage range generator means for generating a lower limit voltage at a lower end of said first predetermined voltage range, and an upper limit voltage generator means for generating an upper limit voltage at an upper limit of said first predetermined voltage range.

* * * * *